United States Patent [19]

Lemon

[11] Patent Number: 4,645,072

[45] Date of Patent: Feb. 24, 1987

[54] CONTAINER CARRIER

[76] Inventor: William C. Lemon, P.O. Box 6064, Incline Village, Nev. 89450

[21] Appl. No.: 670,392

[22] Filed: Nov. 13, 1984

[51] Int. Cl.[4] ..... B65D 75/00

[52] U.S. Cl. ..... 206/199; 206/143; 206/162; 206/193; 206/194; 206/427; 229/52 BC

[58] Field of Search ..... 206/162, 167, 192, 193, 206/194, 197, 199, 427, 45.31, 163, 188, 143; 229/28 BC, 52 BC

[56] References Cited

U.S. PATENT DOCUMENTS

| | | | |
|---|---|---|---|
| 2,653,742 | 9/1953 | Currie | 229/52 BC |
| 2,701,661 | 2/1955 | Murray | 206/197 |
| 2,975,934 | 3/1961 | Powell | 206/193 |
| 3,140,036 | 7/1964 | Spery | 206/193 |
| 3,193,134 | 7/1965 | Cote | 206/194 |
| 3,257,064 | 6/1966 | Davis | 206/194 |
| 3,367,557 | 2/1968 | Farquhar | 206/197 |
| 3,442,421 | 5/1969 | Donahue | 206/194 |
| 3,495,734 | 2/1970 | Hanna et al. | 206/194 |
| 3,618,757 | 11/1971 | Funkhouser | 206/194 |
| 3,680,765 | 8/1972 | Harrelson | 206/197 |
| 4,201,294 | 5/1980 | Roccaforte | 206/45.31 |
| 4,498,582 | 2/1985 | Tomassi et al. | 206/427 |

*Primary Examiner*—Joseph Man-Fu Moy
*Assistant Examiner*—David T. Fidei
*Attorney, Agent, or Firm*—Prutzman, Kalb, Chilton & Alix

[57] ABSTRACT

A container carrier adapted for receiving a plurality of containers for transportation of same is assembled from a unitary sheet of plastic. The containers are captured between retainer edges of transverse members forming a supporting web at the lower portion of the carrier. The panels function to clamp the containers in position upon seating of the containers in the carrier. In a filled configuration the carrier is supportable on a plurality of legs which are configured to cooperate with the transverse members for retainably capturing the containers.

12 Claims, 5 Drawing Figures

CONTAINER CARRIER

BACKGROUND OF THE INVENTION

This invention relates to carriers adapted for carrying a plurality of articles such as bottles, cans and the like. More particularly, this invention relates to reusable carriers formed of thermoplastic, paper or like materials.

Numerous carriers have heretofore been provided for the efficient manual transportation and storage of bottles and cans. Conventionally, such carriers are formed of cardboard or molded fibrous materials and include folded handles and box-like extensions on opposite sides of the handles to receive a plurality of containers, commonly configured three to a side, in the version known as the six-pack. The conventional carrier formed of fibrous materials has enjoyed immense popularity despite numerous disadvantages associated with the material. For example, the container carrier constructed of fibrous material tears easily and disintegrates when wet. Re-utilization of the conventional fibrous type carrier is very limited and, of course, the conventional fibrous type carrier is not generally cleanable.

Container carriers formed of plastic have properties which are very advantageous in comparison to the fibrous type container carrier. Plastic carriers maintain their shape, strength and structural integrity when wet. The plastic carriers are relatively light in weight, easily cleaned and can be fabricated to conform to numerous container shapes. A principal feature is the reusability characteristics of plastic container carriers. In addition, the rapidly advancing technology in the manufacturing and assembling of plastic materials and in printing processes for plastic materials makes the use of plastic carriers increasingly favorable economically and aesthetically in comparison to the conventional fibrous type container carrier.

U.S. Pat. No. 3,773,214 entitled "CONTAINER CARRIER" and issued to the inventor of the present invention is exemplary of container carriers which are specifically adaptable for construction with thermoplastic and/or molded materials and which may be constructed from a single unitary sheet of plastic material.

BRIEF SUMMARY OF THE INVENTION

The present invention is a new and improved container carrier which is especially adaptable for construction from thermoplastic material. The carrier may be manually assembled without requiring automated machinery.

Briefly stated, the invention in a preferred form is a container carrier which may be formed from a unitary sheet of material. The carrier comprises a multi-layer central supporting panel which forms at an upper portion a handle for grasping the carrier. An apertured top cover extends from the central panel and forms a web to protectively separate individual containers. A pair of side panels extend from the cover and form in cooperation with the cover and the central panel two rows of receptacles each of which are adapted for receiving a container. A support web comprising a multiplicity of transverse members connect the side panels and central panel at lower portions thereof. The transverse members form opposing pairs of cooperating edges. A supporting platform connects the transverse members. A multiplicity of support legs extend from lower portions of the central and side panels. A container seated in a formed receptacle is supported by the platform and captured between cooperating edges of the transverse members. The legs extend downwardly to provide generally vertical support for the carrier and cooperate with the transverse members to force the side and central panels into a clamping engagement with a received container.

The carrier cover also preferably includes a plurality of pairs of flaps which are adapted for deflection to engageably retain a received container. The transverse members are disposed in a generally oblique relationship relative to the legs and the supporting platform when a container is seated in a formed receptacle. The legs and transverse members are die cut from a sheet of material. Opposing free ends of the sheet are received in nestled fashion between outer sheet portions inwardly adjacent an upper creased portion of the central panel.

An object of the invention is to provide a new and improved container carrier.

Another object of the invention is to provide a new and improved container carrier which may be formed from a single unitary sheet of plastic material.

A further object of the invention is to provide a new and improved container carrier which is efficient, lightweight and compact and provides suitable protection for containers received therein and a reliable and rugged supporting structure.

A further object of the invention is to provide a new and improved container carrier which is relatively inexpensive and and can be advantageously re-utilized.

A yet further object of the invention is to provide a new and improved container carrier which may be efficiently manually assembled and does not require automated machinery for the assembly process.

Other objects and advantages of the invention will become apparent from the specification and the drawing.

DETAILED DESCRIPTION OF THE INVENTION

Figure 1:
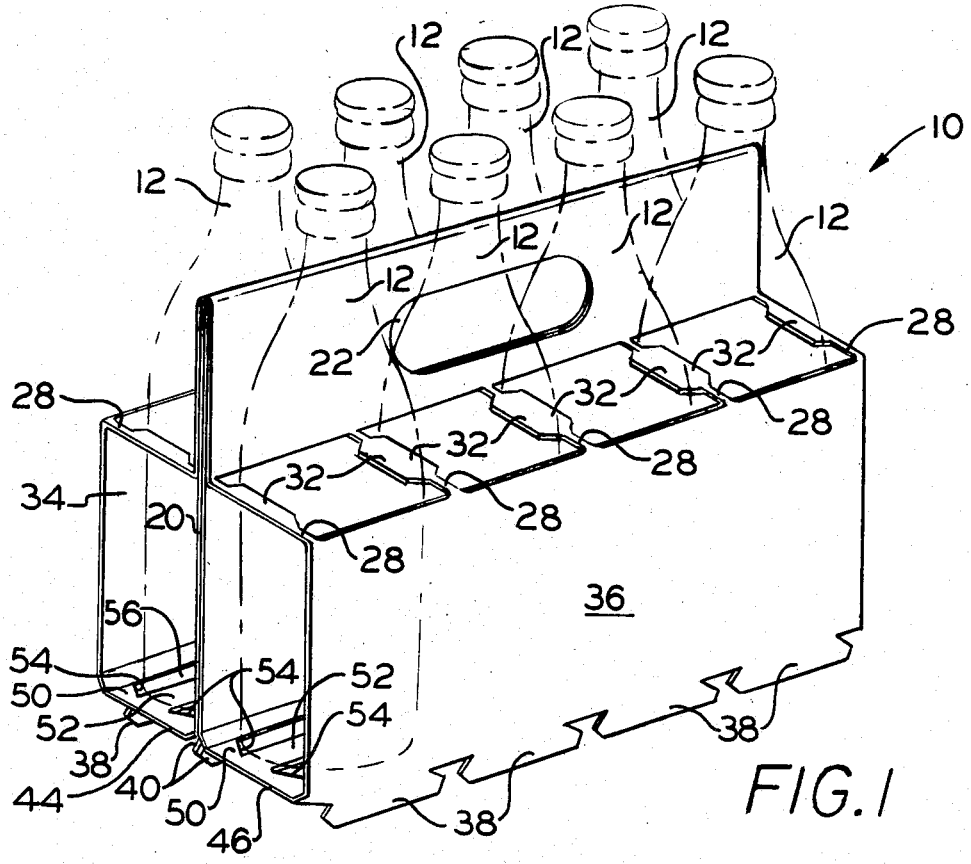
FIG. 1 is a perspective view of an assembled embodiment of the container carrier of the present invention, a plurality of received bottles being partly illustrated in phantom.
Figure 2:
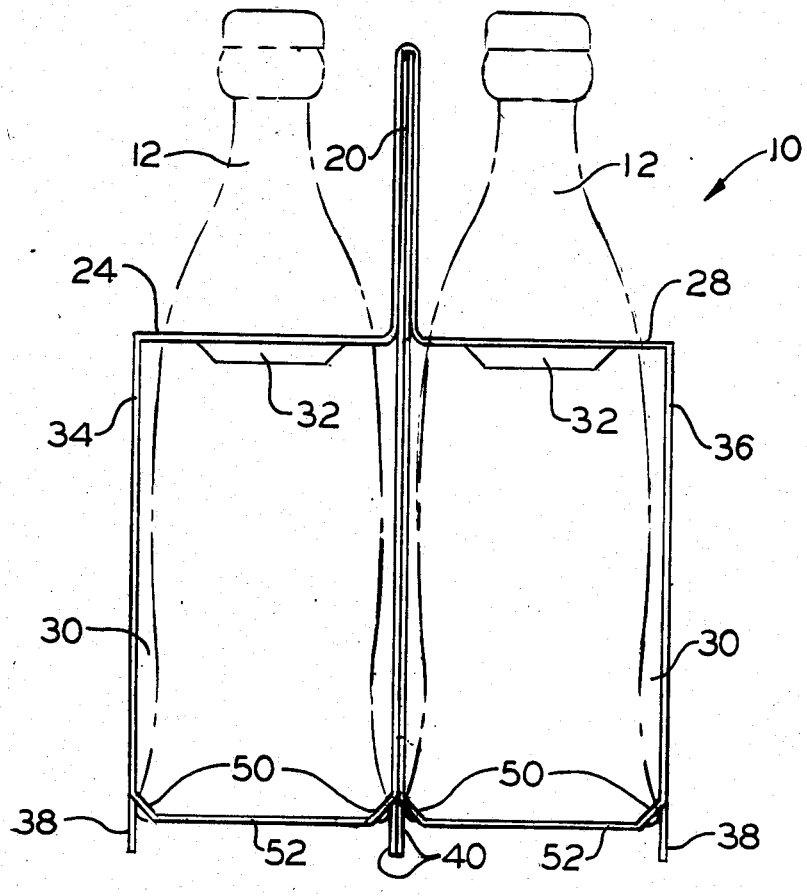
FIG. 2 is an enlarged end elevational view of the assembled embodiment of FIG. 1, two received bottles being illustrated in phantom.
Figure 3:
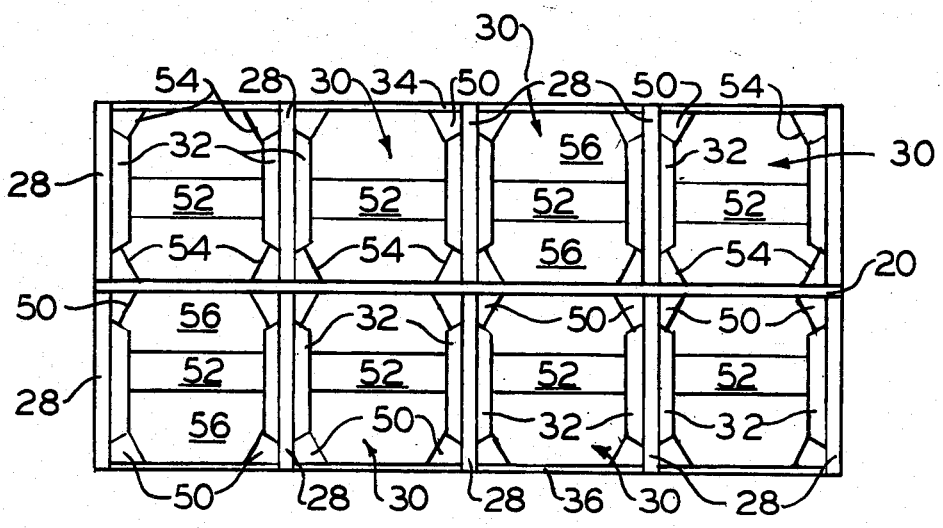
FIG. 3 is a top plan view of the assembled embodiment of FIG. 1.
Figure 4:
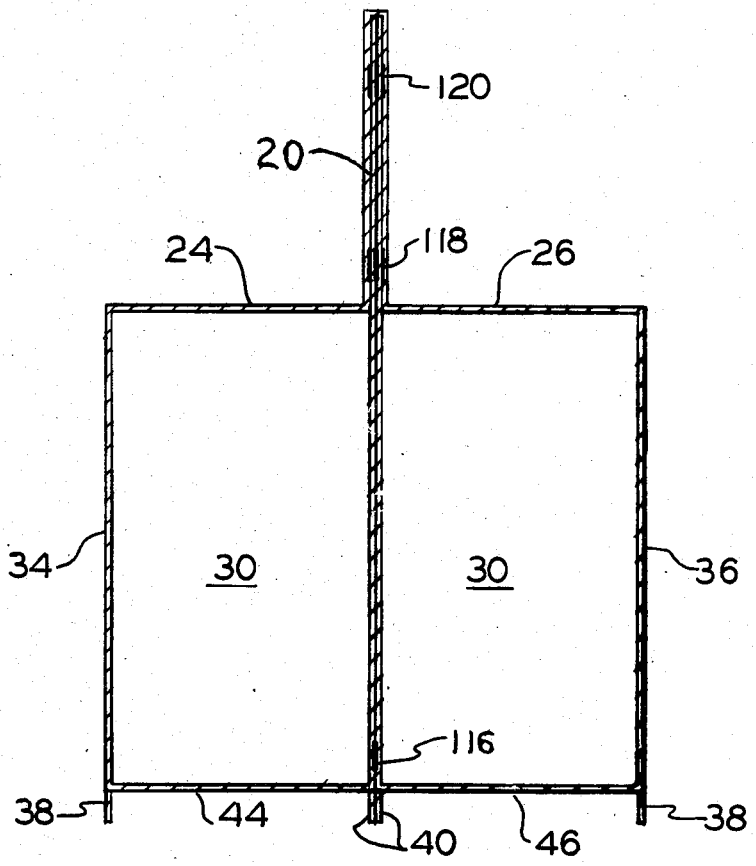
FIG. 4 is an enlarged end sectional view of the assembled embodiment of FIG. 1.
Figure 5:
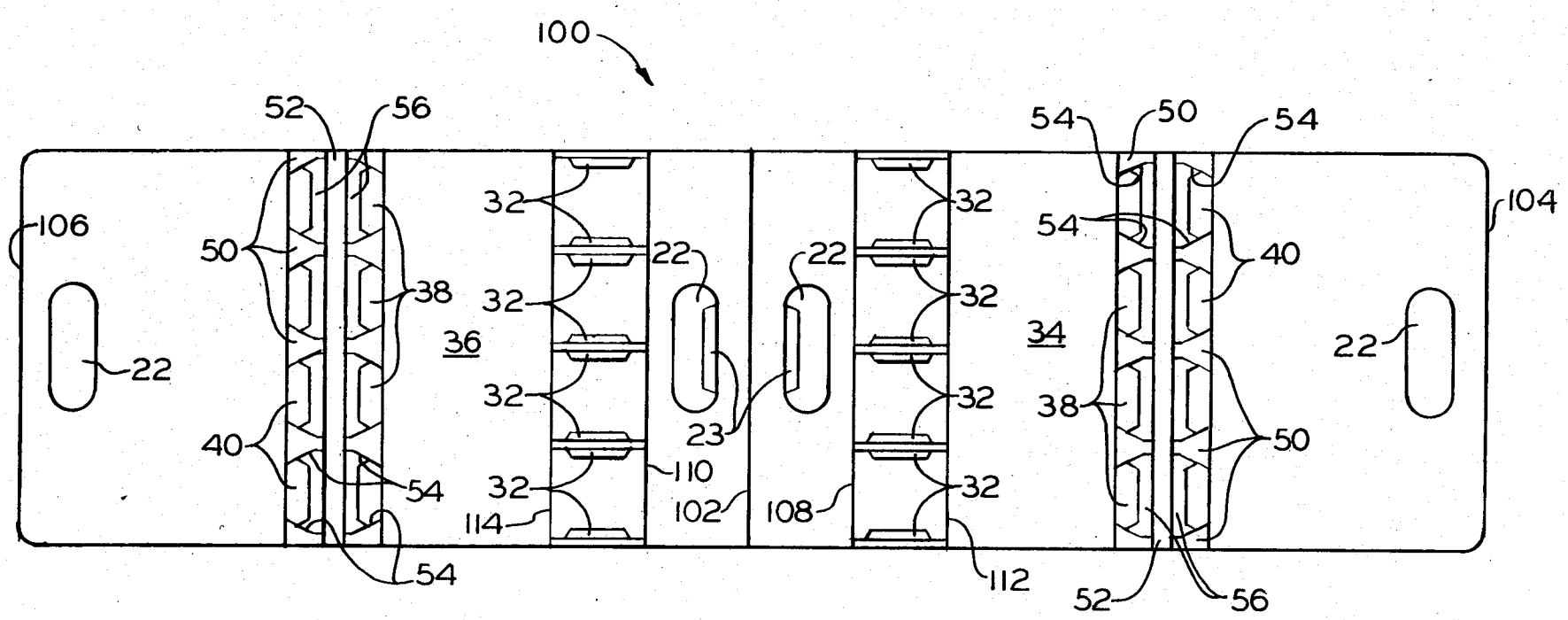
FIG. 5 is a top plan view of an unassembled sheet form of the container carrier embodiment of FIG. 1.

With reference to the drawing wherein like numerals represent like parts throughout the several FIGURES, a preferred form of a container carrier in accordance with the present invention is generally designated by the numeral 10. Container carrier 10 is preferably formed from a unitary sheet of plastic material such as illustrated in FIG. 5. As best illustrated in FIG. 1, the asssembled container carrier 10 is adapted for receiving eight bottles 12 for manual transportation of the bottles. The present invention is equally applicable to carriers adaptable for receiving and transporting other specific quantities of containers such as 2, 4, 6 or 10 beverage bottles. The carrier depicted in FIGS. 1–4 displays a generally erect rigid configuration. In practice container carrier 10 may not assume such a configuration characteristic if containers are not received and/or properly positioned in the carrier because of the relatively flexible lightweight plastic material of which the carrier is preferably constructed.

Container carrier 10 includes a central panel 20 which is a relatively rigid member. Central panel 20 functions as the central support structure for the carrier. In the illustrated embodiment, the top portion of central partition 20 is a four-ply configuration forming a rigid carrier handle having substantial rigidity. An oblong centrally disposed handle aperture 22 is formed in the central panel for facilitating the manual grasping of the carrier. The cut-outs which form the handle aperture may be die-cut to include flaps 23 (illustrated in FIG. 5) which may be folded over at the periphery of the aperture to enhance the comfort of the grip provided by the handle and to increase the structural integrity of the handle portion of the carrier. The material adjacent the boundary of the handle aperture 22 may be thermally welded and/or glued to enhance the structural integrity of the carrier.

A pair of substantially identical top cover portions 24 and 26 integrally extend from opposite sides of the central panel 20. The cover portions 24 and 26 include a plurality of generally transversely extending separators 28. The separators 28 function to define two rows of substantially identical receptacles 30 which are suitably dimensioned and formed for receiving containers such as bottles, cans or the like. In addition to facilitating the retention of received containers, separators 28 function to upwardly separate and protect the received containers from laterally impacting or engaging with each other. Each of the receptacles 30 is preferably partially upwardly defined by a pair of cooperating generally laterally protruding, resilient inwardly directed flaps 32 which are laterally spaced and dimensioned so that a received container forces the flaps 32 to downwardly deflect or deform as best illustrated in FIG. 4. The deflected flaps 32 resiliently engage the sides of the received container to laterally retain the containers in position and to provide a lateral impact barrier between the containers. It will be appreciated that each cover portion forms a row of container pockets or receptacles with the central panel separating the two substantially identical formed rows of receptacles.

A pair of generally upright (in the illustrated carrier mode) side panels 34 and 36 integrally connect with cover portions 24 and 26, respectively, and are (in an erect carrier configuration) substantially parallel to central panel 20. The side panels 34 and 36 may be exteriorly affixed with various printed matter which indicates the contents of the received containers and/or various advertising and/or decorative matter. The side panels 34 and 36 function to provide in cooperation with the central panel 20 a transverse retention structure for the containers as will be further described below. A set of downwardly protruding legs 38 extend from the lower portion of each of the side panels to provide an outer support pedestal for the carrier. The support legs 38 are preferably substantially identical. The legs terminate in a laterally extending elongated edge which in an upright container storage mode contacts a surface upon which the carrier rests. In a preferred form, the intermediate and lower vertical portions of central panel 20 is a two-ply configuration. The lower portions of the central panel 20 extend to form a plurality of legs 40 which are substantially identical to corresponding legs 38 and are generally alignable therewith to provide a central support pedestal for the carrier. Each of the formed receptacles 30 is associated with a support leg 38 of a side panel and a substantially identical support leg 40 of the central panel. The support legs 38 and 40 may be slightly creased along substantially vertical lines (in the upright carrier configuration) to enhance the structural rigidity of the support legs.

A pair of lower support webs 44 and 46 integrally connect the side panels 34 and 36, respectively, with the central panel. Support webs 44 and 46 are substantially identical and are formed from a plurality of transverse members 50 which connect at lower portions of panels 20, 34, and 36 adjacent the upper terminus of the support legs. The transverse members 50 integrally interconnect with a longitudinally extending strip which forms a supporting platform 52 for each of the receptacles.

With reference to FIG. 4, in the assembled erect configuration the width or transverse dimension of each of the support webs 44 and 46 is approximately equal to the width or transverse dimension of cover portions 24 and 26. The foregoing transverse dimensions are also approximately equal to the diameter of the container to be received in the respective formed receptacles 30. Each of the transverse members defines a pair of retainer edges 54 (excepting for the end transverse members which have a single retainer edge 54). The retainer edges 54 are configured and spaced to partially form in combination with the boundaries of the support platform a pair of congrument openings 56 at the bottom of each of the receptacles. The bottom openings closely receive the lower portion of the container so that four angularly spaced side portions of the container are engageably interposed between corresponding cooperating retainer edges 54. Upon receiving a container in a receptacle 30 of an upright positioned carrier and seating the container against the supporting platform 52, the rigidity of the legs 38 and 40 withstand the downward seating force and cooperate to force the transverse members 50 to an extended, taut configuration having a generally oblique orientation relative to the support legs and supporting platform as best viewed in FIG. 2. When a container is fully seated in a receptacle, the platform 52 is generally disposed at a right angle to the plane of the panels and depending legs. In an upright filled configuration wherein the carrier rests on a surface via support legs 38 and 40 the platform 52 may also be forced to engage the downwardly adjacent surface upon which the carrier rests. The retainer edges 54 function to capture the lower portion of the container and are correspondingly dimensioned to closely conform to the dimensions of the received container. The edges 54 essentially obliquely engage four angularly spaced lower circumferrential portions of a seated container.

The foregoing described seating of a container also functions to provide a clamping transverse engagement of the container between the adjacent side panel and the central panel. This latter feature results from the downward angular extension of the transverse members 50 to an oblique orientation relative to the supporting platform 52 and the legs 38 and 40. The foregoing seated configuration tends to force the transverse members to a semi-rigid taut configuration which forces the side and central panels toward each other. In a preferred configuration, the transverse members form an angle of 45° with the adjacent support legs 38 and 40. It will, of course, be appreciated that each receptacle has a substantially identical configuration wherein at the lower portion thereof the retainer edges function in an efficient manner to laterally protectively retain the seated received containers to prevent the containers from laterally engaging or impacting with each other. Lateral protective retention is principally provided at the upper portion of the seated containers by the flaps 32 and/or separators 28. Transverse protective container retention is provided by the central panel 20. The received containers may thus be efficiently and protectively transported by grasping the carrier through aperture 22 and transporting the carrier.

An advantageous feature of the foregoing described container carrier is that the carrier may be constructed in an efficient and inexpensive manner. The carrier is preferably assembled from a unitary sheet of plastic material which has generally been designated by the numeral 100 in FIG. 5. Sheet 100 may also be constructed from paper, cardboard or other fibrous materials. The sheet 100 is substantially rectangular and preferably has a constant thickness on the order of 0.018 to 0.020 inches. With further reference to FIG. 5, the sheet 100 may be die-cut as illustrated to form the foregoing described features including handle aperture 22, flaps 32, legs 38 and 40, transverse members 50 and supporting platform 52. The preferred complementary shape relationship between transverse members 50 and the support legs 38 and 40 is best illustrated in FIG. 5. Additional optional cut-outs may also be die-cut from the panels to further reduce the required material for the carrier and for weight reduction.

A laterally extending score or crease line 102 is preferably pre-formed on sheet 100 to facilitate the assembling process. Crease line 102 is equidistantly spaced from the opposite free ends 104 and 106 of sheet 100. Parallel secondary score or crease lines 108, 110, 112 and 114 may also be pre-formed on the sheet to sharply define the transition between the cover portions and the panels. It will be appreciated that the assembly process is essentially symmetric relative to central line 102. The sheet is folded along the crease lines 102, 108, 110, 112 and 114. The folds along lines 108 and 110 are reverse folds. Parallel folds are also made at or near the intersection of the transverse members 50 and the panels. The portions of sheet 100 adjacent the free ends 104 and 106 are juxtaposed in mating front-to-front relationship and inserted into the pocket formed by the fold along central crease line 102. The four cut-outs forming handle aperture 22 are suitably aligned. A substantially box-like erected configuration of the carrier is thus formed. Glue may then be applied along glue strips 116, 118 and 120 as illustrated in FIG. 4. The carrier may thus be efficiently manually assembled without employing automated machinery.

Because the described carrier is preferably formed of a thin plastic material or other relatively thin material, the container carrier may not assume a precise box-like configuration having sharply defined corners and planar surfaces when containers are not inserted into the carrier. In an unfilled configuration, the container carrier in fact may be flattened to a substantially planar compact configuration for storage or distribution purposes. The carrier may be easily transformed from the planar configuration to the erect upright configuration for reception of containers as desired. Transformation of the carrier to a flat planar configuration does not effect the integrity of the carrier when it is substantially transformed to an erect upright configuration for receiving and transporting containers. In the configuration wherein the containers are seated in the carrier, the retained containers and the carrier essentially combine to form a rigid structure which provides for protective retention of the containers within the carrier and also provides a substantially rigid carrier for transporting the containers. It will be appreciated that the foregoing described container carrier may be dimensioned to accommodate carriers of differing sizes and configurations as desired.

While a preferred embodiment of the foregoing described container carrier has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A container carrier formed from a unitary sheet of material comprising:

a multi-layer central supporting panel forming at an upper portion a handle means to grasp said carrier and at a lower portion a first set of support legs;

a top cover extending from opposite sides of said central panel and forming a plurality of apertures;

a pair of side panels extending from said cover and forming in cooperation with said cover and central panel two rows of receptacles opening through said apertures and including at a lower portion a second set of support legs; and a lower support web connecting said central panel and side panels at lower portions thereof, said support web comprising a plurality of longitudinally spaced transverse members forming retainer edges and a longitudinally extending support platform for each said receptacle interconnecting said members so that the central and side panels may be generally uprightly supported by said first and second set of legs and a container received in a said receptacle may be captured between said retainer edges and seated against said platform to clamp the containers between said central and side panels.

2. The container carrier of claim 1 wherein said handle means is an opening formed in said central panel.

3. The container carrier of claim 1 wherein said apertures are partially defined by a pair of opposing resilient flaps which are deflectable for retentive engagement against a container received in a said receptacle.

4. The container carrier of claim 1 wherein said transverse members extend obliquely relative to said legs and supporting platform when a container is seated in a receptacle.

5. The container carrier of claim 1 wherein the legs and transverse members are die cut from said sheet and opposing edges of said sheet are received in nestled fashion between outer sheet portions adjacent an upper creased portion of said central panel.

6. The container carrier of claim 1 wherein the sheet is plastic.

7. A container carrier comprising:

a central supporting panel forming at an upper portion thereof a handle means to grasp the carrier;

a top cover extending from opposite sides of said central panel and forming a plurality of apertures;

a pair of side panels extending from said cover and forming in cooperation with said cover and central panel two rows of receptacles adapted for receiving containers through said apertures; and a lower support web extending between said central panel and the side panels and comprising a plurality of longitudinally spaced transverse members forming retention edges and a longitudinally extending support platform associated with each said receptacle and interconnecting adjacent members so that the carrier may be generally uprightly supported by said central and side panels and when a container is seated against said support platform, the container is captured between cooperating edges of said transverse members and the side and central panel portions adjacent the lower end of the container cooperate to generally uprightly support the panels and force the panels into a clamping engagement with the lower end of the container.

8. The container carrier of claim 7 wherein the central panel and the side panels form depending lower pairs of support legs for each said receptacle and upon seating a container against a said support platform said transverse members are oriented at an oblique angle relative to said legs.

9. The container carrier of claim 8 wherein each receptacle has four cooperating retention edges.

10. The container carrier of claim 8 wherein the support legs and transverse members have corresponding complementary portions.

11. The container carrier of claim 1 wherein the support of legs of said first set are substantially co-planar with said central supporting panel and the support legs of said second set are substantially co-planar with said side panels.

12. The container carrier of claim 8 wherein said support legs are substantially co-planar with respective central and side panels to support a seated container in an upright relationship in said carrier.

* * * * *